United States Patent [19]

Kayser et al.

[11] 4,171,107

[45] Oct. 16, 1979

[54] WINDING-UP DEVICE FOR PAPER WEBS, ESPECIALLY WIDE PAPER WEBS ON A DRIVEN CYLINDER

[75] Inventors: Franz Kayser, Kerken; Richard Rauf, Krefeld; Wimmar Schmitz, Kempen; Jürgen Schlunke, Krefeld, all of Fed. Rep. of Germany

[73] Assignee: Kleinewefers GmbH, Krefeld, Fed. Rep. of Germany

[21] Appl. No.: 911,687

[22] Filed: Jun. 1, 1978

[30] Foreign Application Priority Data

Jun. 2, 1977 [DE] Fed. Rep. of Germany ..... 2724935

[51] Int. Cl.[2] ..... B65H 17/02; B65H 23/10

[52] U.S. Cl. ..... 242/67.1 R; 242/75.2

[58] Field of Search ..... 242/75.2, 65, 66, 67.1 R, 242/67.2, 67.3, 67.4, 67.5

[56] References Cited

U.S. PATENT DOCUMENTS

| | | | |
|---|---|---|---|
| 3,387,798 | 6/1968 | Young | 242/67.1 R |
| 3,670,980 | 6/1972 | Mukai | 242/67.1 R |
| 3,749,328 | 7/1973 | Dusenbery | 242/67.1 R |

*Primary Examiner*—Edward J. McCarthy

*Attorney, Agent, or Firm*—Becker & Becker, Inc.

[57] ABSTRACT

A winding-up device for paper webs, especially wide paper webs, on a driven cylinder with a guiding roller which is adapted in response to an increase in the diameter of the wound up web material by means of two cylinder-piston units to be tilted away from the cylinder shaft while a constant distance is maintained between the guiding roller and the surface of the wound-up webs. The device comprises two pitot heads or tubes respectively radially directed toward each end of the cylinder and toward the wound-up webs. The device furthermore comprises two converter containers individually connected to the cylinder chambers on both sides of the piston of the hydraulic cylinder piston units, and acted upon by different pressures. The winding-up device also has a 2/2 way valve and a parallelly arranged check valve while the pitot head and the converter containers are adapted together to be connected to a compressed air network.

6 Claims, 3 Drawing Figures

Figure 1:
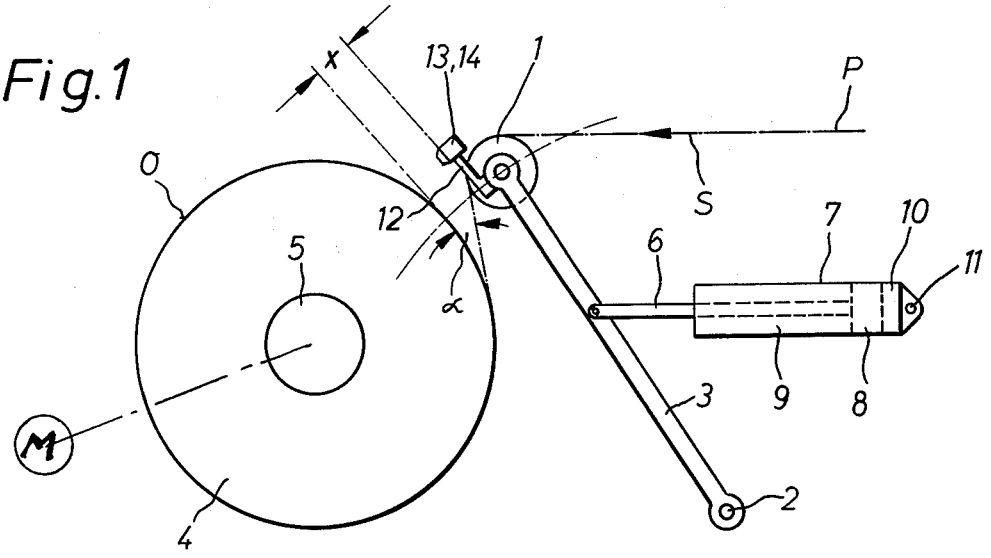

WINDING-UP DEVICE FOR PAPER WEBS, ESPECIALLY WIDE PAPER WEBS ON A DRIVEN CYLINDER

The present invention relates to a winding-up device for paper webs, especially wide paper webs on a driven cylinder, which device is provided with a guiding roller adapted in response to an increase in the diameter of the wound-up web (Wickelbunddurchmessers), by means of two cylinder piston units to be tilted away from the cylinder shaft, while a constant distance is maintained between the guiding roller and the surface of the wound-up web. Winding-up devices for driven winding rollers or cylinders are known in which a guiding roller by means of one or two cylinder piston units is kept in engagement with the wound-up web while the pressure at which the guiding roller is pressed against the surface of the winding-up web may be varied by the cylinder piston unit. Winding-up devices of this type have been described for instance in German Gebrauchsmuster No. 18 90 469.

In order to be able to vary the angle at which the paper web moves onto the cylinder, in other words in order to vary the angle between the paper web and the tangent to the wound-up web along the contact line of the web with the wound-up web material, winding-up devices have been suggested according to which the guide roll can be held at constant distances from the surface of the web wound up on the cylinder. The employed feeler and sensing devices for the surface of the wound-up web on one hand as well as the control devices for actuating the adjusting means for the guiding roller have in this instance to be adapted to the surface of the paper web, for instance to the light reflection capability thereof.

On the other hand, adjusting means for the guiding roller in these known devices are rather expensive and require numerous elements. Moreover, these known winding-up devices are suitable only for narrow paper webs which permit the employment of a single surface feeling arrangement. With these heretofore known devices, a "soft," which means a springy, resilient, winding with the engagement of the winding-up web by the guiding roller is not possible.

It is, therefore, an object of the present invention to provide a winding-up device of the above mentioned general type in which on one hand the adjusting device on the guiding roller can be effected by simple energy means, for instance by means of the compressed air of a compressed air arrangement in the plant.

It is still another object of this invention to provide a winding-up device as set forth in the preceding paragraph, which will be usable for wide paper webs and in which the position of the guiding roller can be adapted to the circumference of the wound-up web in such a way that an edgewise precise winding of the web can be effected while the surface of the paper web will not affect the adjusting movement of the guiding roller to any material extent, especially when the angular position of the device feeling the surface of the wound-up web changes with increasing diameter of the wound-up web.

It is still another object of this invention to provide a winding-up device as set forth in the two preceding paragraphs in which the adjustment of the space between the guiding roller and the surface of the wound-up web can as easily be adjusted as the pressure at which the guiding roller is pressed, after interposing the paper web, against the wound-up material while the pressing-on pressure is kept resilient, whereas the guiding roller in its respective position in spaced relationship to the wound-up material is to be rigid and non-movable until the guiding roller occupies a new position at the desired distance.

Figure 2:
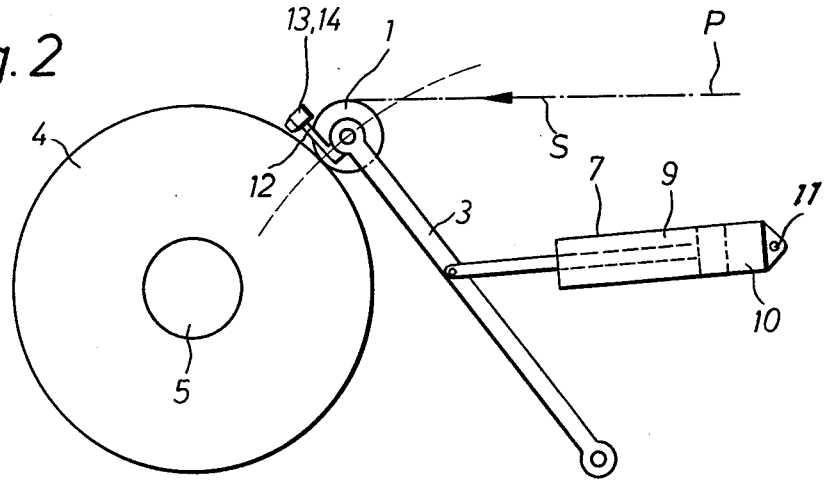

These and other objects and advantages of the invention will appear more clearly from the following specification in connection with the accompanying drawings, in which:

FIGS. 1 and 2 diagrammatically illustrate the positions of the guiding roller relative to the wound-up material.

Figure 3:
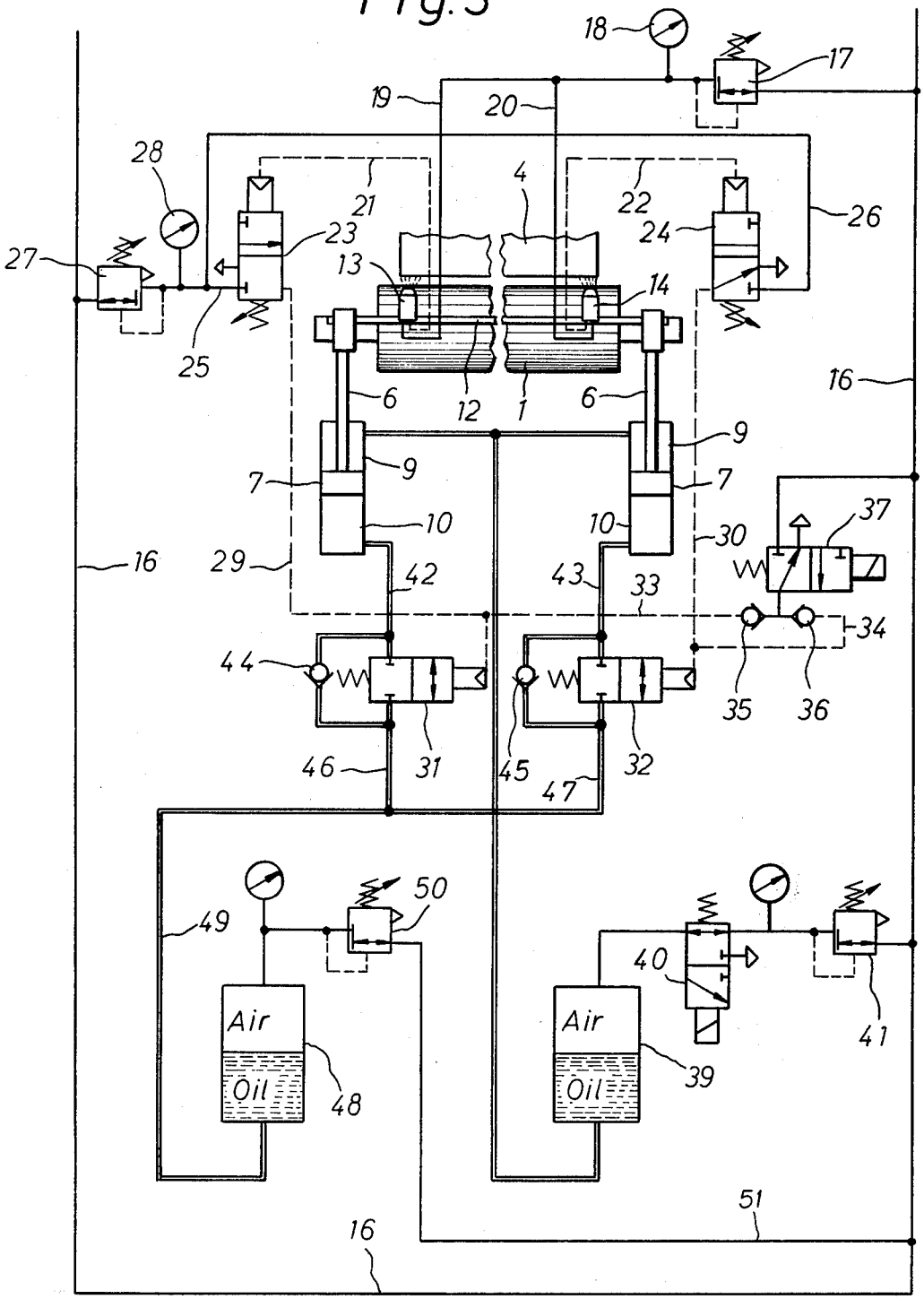

FIG. 3 shows the control circuit for adjusting and arresting the guiding roller.

The winding-up device according to the present invention is characterized primarily by two radial pitot heads or tubes which are respectively directed toward each end of the cylinder or the wound-up web. The invention is furthermore characterized by two converter containers which are individually connected to the two cylinder chambers on both sides of the piston of hydraulic piston units, said converter containers being acted upon by different pressures. The winding-up device according to the invention furthermore comprises a 2/2 way valve and a parallelly arranged check valve while the pitot heads or tubes and the converter containers are adapted together to be connected to a network of compressed air. Whereas those cylinder chambers which face the guiding roller are through a common conduit connected with the converter container of a higher pressure, those cylinder chambers which face away from the guiding roller are through separate conduits connected to the 2/2 way valves and the check valves. Only these parts are through a common conduit connected to the container of a lower pressure.

According to a further development of the invention, between the pitot heads or tubes and the 2/2 way valve, a computing or pressure-translating valve is provided which translates the control pressure of the pitot heads or tubes upwardly by a multiple in order to control the two 2/2 way valves of the conduit conveying the lower pressure.

According to a preferred embodiment of the invention, a magnetic valve is arranged between the converter container with higher pressure and the compressed air conduit. By actuation of said magnetic valve it is possible to move the guiding roller after a change of the wound-up web again to its desired working position.

With the actual embodiment of the invention, the pitot tubes are adjustably arranged on a common traverse which has its ends connected to the pivotal arms of the guiding roller.

Referring now to the drawings in detail, according to FIGS. 1 and 2, the paper web P is from a non-illustrated unwinding station in the direction S passed over a freely rotatably guiding roller 1, the axles of which are supported at 2 by the upper end of two parallel pivotable arms 3 the roller axles are journalled in pedal bearings (Pedallagern) of the pivotal arms 3. After being looped around a portion of the guiding roller over an angle of from 90°–180°, the paper web P passes onto the wound-up web on the driven cylinder 5. Each of the two pivot arms 3 is engaged by the connecting rod 6 of a cylinder piston unit 7 which comprises the two cylinder chambers namely the front chamber 9 and the rear chamber 10, of the piston 8. The cylinder pivotable at 11 is a hydraulic cylinder with inlets and outlets further referred to below.

FIG. 1 shows one of the two working positions of the guiding roller independently of the diameter of the wound-up web 4 on the cylinder 5. The guiding roller 1 has a constant but adjustable distance from the surface 0 of the wound-up material 4 so that the inlet angle $\alpha$ of the paper web, which means the angle between the paper web and the tangent to the wound up material, is at the connecting line of the web with the wound-up material always nearly constant (with increasing diameter of the wound-up web, the angle becomes slightly less). In this way, the air pulled in at the mentioned angle between the paper web and the surface of the wound-up web will on one hand remain substantially constant but can be selected by changing the distance X in conformity with the paper and winding type.

FIG. 2 shows a working position of the device, i.e., the engagement of the guiding roller with the wound-up material (with the interposition of the web section to be supplied in straight condition), while the pressure at which the guide roller 1 presses against the wound-up material is likewise selectable. In this connection the pressure is resilient. For the above mentioned operation of the guiding roller 1, the two pivotal arms 3 have a traverse 12 between their upper ends, on which traverse at the level of the two ends of the wound-up material 4, there are arranged two pitot heads or tubes 13, 14 which are adjustable toward and away from each other. The inclination of said pitot heads or tubes with regard to the surface of the wound-up material may be adjustable.

The compressed air conveying conduit 16 of a conduit network feeds an adjustable pressure reducing or compensating valve 17 the starting pressure of which can be read on the pressure gauge 18. The two pitot heads or tubes 13, 14 are acted upon through conduits 19, 20, and the pressure head is generated to which corresponds an exact defined distance between the pitot tubes and the adjacent end of the wound-up material 4. The pressure head is through conduits 21, 22 conveyed to the control element of a pressure translating device or to the 3/2 way valve 23, 24. The pressure conduit 25, 26 of the pressure translating device or the 3/2 way valve 23, 24 is fed by a pressure reducing valve 27 which is provided with a pressure gauge 28 and is connected to the compressed air conduit 16 of the conduit network. The pressure head of the valves 23, 24 increased by about 5,000 times, passes through the conduits 29,30 to the 2/2 way valves 31, 32 while in the conduits 33, 34 which are connected to the conduits 29, 30 and are also connected to each other there are arranged two oppositely directed check valves 35, 36 between which the mouth of the feed line of a 3/2 way valve 37 is located which valve 37 is connected to the compressed air line 16.

The front cylinder chambers 9 of the two cylinders 7 are interconnected while the common feed and withdrawing lines 38 are connected to a converter container 39. The container 39 is filled partially with oil under pressure and its upper section communicates with a 3/2 way magnetic valve 40 which latter is connected to the conduit 16 through the intervention of the pressure reducing and compensating valve 41.

In contrast thereto, each feeding and withdrawing line 42, 43 of the cylinder chambers 10 are individually and separately connected to the valves 31, 32 and the check valves 44, 45 arranged in parallel thereto. Only the discharge conduits 46, 47 are united to form the conduit 49 which leads to the second converter container 48. The container 48 communicates through the pressure reducing and compensating valve 50 through the intervention of conduit 51 with the compressed air network conduit 16. While in the container 48 a lower pressure prevails than in the container 39, the container 48 is likewise filled with oil. Also the valves 41, 50 are likewise pressure adjustable.

When the pitot tubes 13, 14 measure the desired distance X, valves 31, 32 close, and the guiding roller 1 is arrested which means is rigid with regard to outer forces. If by means of the pitot tubes 13, 14 it is ascertained that in view of the increasing diameter of the web material being wound up, due to the increase in said diameter, the rated distance X has dropped below its rated value, the valves 31, 32 open. If the guiding roller is intended to be moved away from the wound-up paper web, for instance in order to remove a finished bolt from the cylinder, the blocking valves 31, 32 are opened by means of the valve combination 34, 35, 37. After insertion of an empty cylinder 5, it is necessary that the guiding roller 1 can be moved in the direction toward the cylinder. To this end, the converter container 39 is impeded at its compressed air side by the valve 40 so that the oil under pressure passes from the converter container 48 through the check valves 44, 45 into the rear chambers 10 of the cylinders 7. As soon as the guiding roller has contact with the cylinder, the converter container 39 is by actuating the valve 40 again put under pressure, and the pitot tubes 13, 14 again restore the distance X.

For the position "guiding roller in contact with the wound up web," it is necessary to activate the valve 37 in order to open the valves 31, 32. Each desired pressure can then be set by means of the pressure reducing valves 41, so that the guiding roller remains in contact with the paper roll and exerts a pre-selectable line pressure upon the paper. Inasmuch as the pressure is by means of an air cushion exerted in the container 48, the pressure forms a resilient pressure in view of the compressibility of air although the control is hydraulic and as a result thereof the holding of the guiding roller in a rest position is rigid because the hydraulic chambers 9, 10 are in this instance closed off from the air cushion in the container.

It is, of course, to be understood that the present invention is, by no means, limited to the specific showing in the drawings, but also comprises any modifications within the scope of the appended claims.

What we claim is:

1. A winding-up device for paper webs, which includes: a rotatable winding-up cylinder for receiving and winding up a paper web, a rotatable guiding roller, two cylinder-piston means operatively connected to opposite ends respectively of said guiding roller for tilting the same toward and away from said cylinder, two pitot tubes associated with and respectively directed toward the end portions of said guiding roller and adjustable toward and away from each other, each of said cylinder-piston means having a cylinder with a reciprocable piston therein dividing said cylinder into a first and a second cylinder chamber, first and second converter containers adapted respectively to be subjected to different pressures, first conduit means for establishing communication between said first converter and said first cylinder chambers, control valve means associated with said first converter container for selectively placing said first converter container under pressure and relieving said first container from pressure, second conduit means for establishing fluid communication between said second converter container and said second cylinder chambers, two 2/2 way valves respectively associated with said second cylinder chambers, and two check valves respectively arranged in parallel to said 2/2 way valves, said pitot tubes and said converter containers being connectable to a common compressed air network.

2. A device according to claim 1, which includes pressure translating means interposed between said pitot tubes and said 2/2 way valves and arranged in that one of said first and second conduit means having lower pressure therein.

3. A device according to claim 1, in which said control valve means is a magnetic valve.

4. A device according to claim 1, in which each of said pitot tubes has associated therewith one of said 2/2 way valves and one of said check valves, while said second converter container is common to both of said pitot tubes.

5. A device according to claim 1, in which the inclination of said pitot tubes relative to said winding-up cylinder is adjustable.

6. A device according to claim 5, which includes two pivotal arms arranged in spaced relationship to each other and having one end thereof supporting said winding-up cylinder and a traverse adjustably supporting said pitot tubes.

* * * * *